US006592381B2

(12) United States Patent
Cohen et al.

(10) Patent No.: US 6,592,381 B2
(45) Date of Patent: Jul. 15, 2003

(54) WAFERIZED POWER CONNECTOR

(75) Inventors: Thomas S. Cohen, New Boston, NH (US); Allan L Astbury, Jr., Amherst, NH (US); Steven J. Allen, Nashua, NH (US)

(73) Assignee: Teradyne, Inc., Boston, MA (US)

( * ) Notice: Subject to any disclaimer, the term of this patent is extended or adjusted under 35 U.S.C. 154(b) by 0 days.

(21) Appl. No.: 09/769,867

(22) Filed: Jan. 25, 2001

(65) Prior Publication Data

US 2002/0098724 A1 Jul. 25, 2002

(51) Int. Cl.[7] ..... H01R 12/00
(52) U.S. Cl. ..... 439/80; 439/65
(58) Field of Search ..... 439/65, 78–81, 439/608–701, 717, 731, 629–638

(56) References Cited

U.S. PATENT DOCUMENTS 4,820,169 A 4/1989 Weber et al. ..... 439/65
5,139,426 A * 8/1992 Barkus et al. ..... 439/65
5,158,471 A * 10/1992 Fedder et al. ..... 439/80
5,295,843 A 3/1994 Davis et al. ..... 439/108
5,360,349 A * 11/1994 Provencher et al. ..... 439/108
5,575,690 A 11/1996 Eaton ..... 439/717
5,672,064 A * 9/1997 Provencher et al. ..... 439/79
5,795,191 A * 8/1998 Preputnick et al. ..... 439/608
5,961,355 A * 10/1999 Morlion et al. ..... 439/79 X
6,123,586 A * 9/2000 MacDougall ..... 439/79 X
6,293,827 B1 * 9/2001 Stokoe ..... 439/608
6,319,075 B1 * 11/2001 Clark et al. ..... 439/78 X

FOREIGN PATENT DOCUMENTS

EP 0546505 6/1993

* cited by examiner

*Primary Examiner*—Son V. Nguyen
(74) *Attorney, Agent, or Firm*—Teradyne Legal Dept.

(57) ABSTRACT

An interconnect system for printed circuit boards. The interconnect system includes signal wafers that carry high speed signals between printed circuit boards. The interconnect system also includes power modules assembled from wafers. The power modules are compact, easy to manufacture and easily integrate with the signal contact wafers to provide a single connector.

20 Claims, 6 Drawing Sheets

WAFERIZED POWER CONNECTOR

This invention relates generally to electrical interconnect systems and more particularly to power connectors.

Modem electronic systems are often built on multiple printed circuit boards. A traditional configuration for a computerized product, such as a router, is to have a printed circuit board that serves as a backplane. Several other printed circuit boards, called daughter cards, are connected to the backplane. The daughter cards contain the electronic circuitry of the system. The backplane contains traces or planes that route signal and power to the daughter cards. Electrical connectors are attached to the printed circuit boards and electrical connections are made through these connectors.

Different types of connectors are generally used for signals and power connections. Signal connectors should carry many signals in a small area. However, because the signals are often of high frequency, there is a risk of cross-talk. Therefore, the signal connectors often have special shielding.

Power connectors need to carry much higher current than signal connectors. In addition, because the power in an electronic system might have a dangerous voltage, the backplane power connectors often need protective features to prevent a human from accidentally contacting a power conductor. Thus, many of the requirements for signal and power connectors are different.

One requirement of power connectors that does not exist with signal connectors is the need for various mating levels. The mating levels are particularly useful for a function called "hot swap". With hot swap, a connection is made or removed while system power is on. For example, a daughter card might be plugged into a backplane while the power is on. To ensure proper operation of the circuitry on the daughter card, or to avoid damage to the daughter card circuitry, it is often desirable that power be applied to various components in a particular order. Multiple mating levels are used to provide this capability.

The circuits that are to receive power first are connected to the longest power contacts. These contacts mate first and therefore provide power to selected circuits first. As electronic systems get more complicated, the number of mating levels required increases.

Also, as systems get more complicated, the circuitry requires more voltage levels to operate correctly.

It would be desirable to have a power connector that could flexibly handle many voltage levels and mating levels.

Further, we have recognized that for high speed interconnects, it is desirable to have a low inductance power power/return loop.

SUMMARY OF THE INVENTION

With the foregoing background in mind, it is an object of the invention to provide an improved power connector.

The foregoing and other objects are achieved in a waferized power connector. The connector is assembled from two different types of wafers and with an insulative cap. The connector mates with a backplane power module having enclosed contacts.

BRIEF DESCRIPTION OF THE DRAWINGS

The invention will be better understood by reference to the following more detailed description and accompanying drawings in which.

DESCRIPTION OF THE PREFERRED EMBODIMENT

Figure 1:
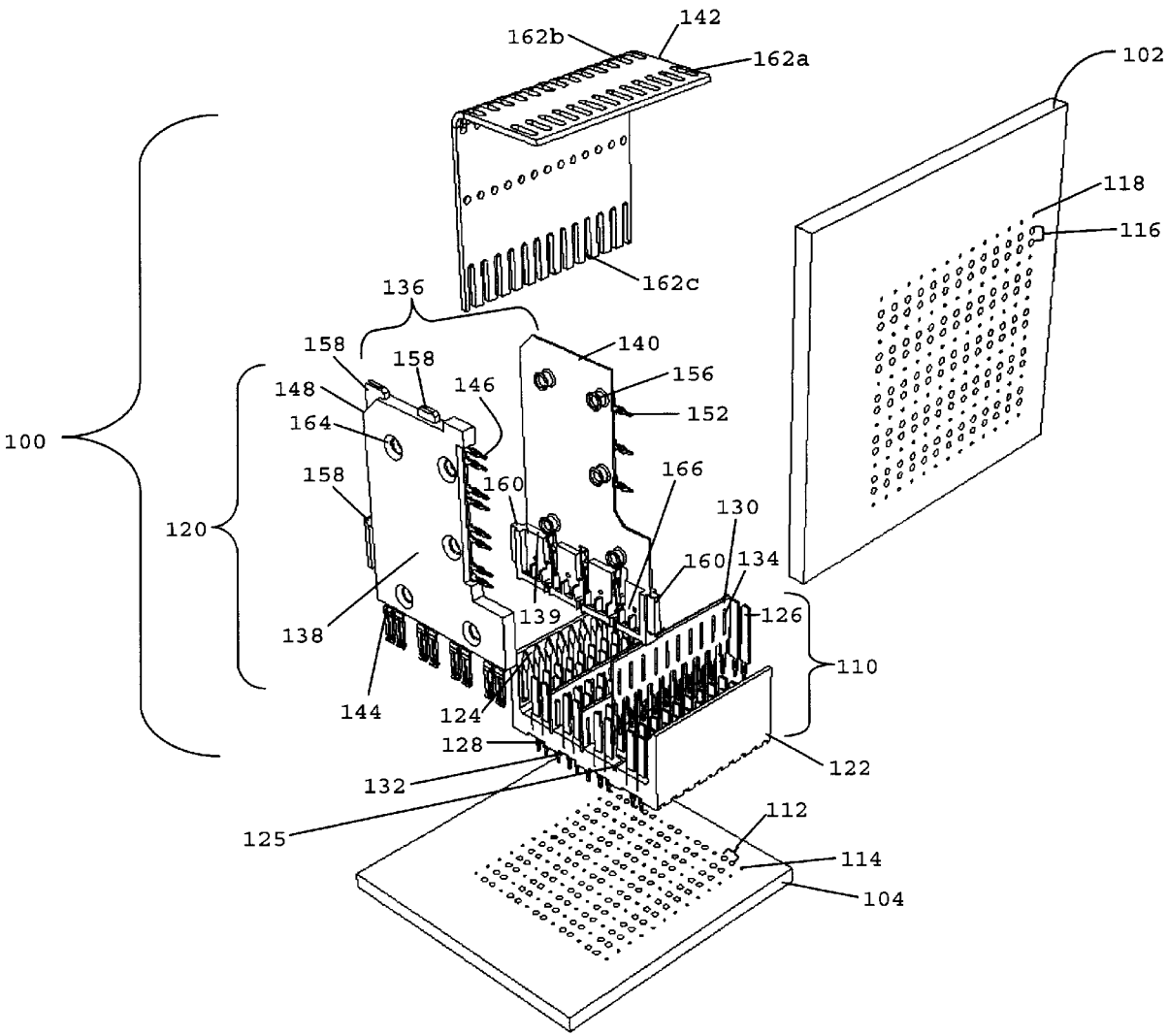
FIG. 1 shows in exploded view a signal connector for use with the invention.

FIG. 1 shows a signal connector portion of a high speed interconnect system. A portion of a backplane 104 is shown and a backplane connector 110 is attached to it. A portion of a daughter card 102 is also shown, a daughter card connector 120 is shown in exploded view. The daughter card connector is assembled from a plurality of subassemblies 136. The subassemblies 136 are attached to a stiffener 142 that has attachment features, such as holes 162*a* and 162*b* and slots 162*c* that both position and secure the subassemblies.

Figure 2:
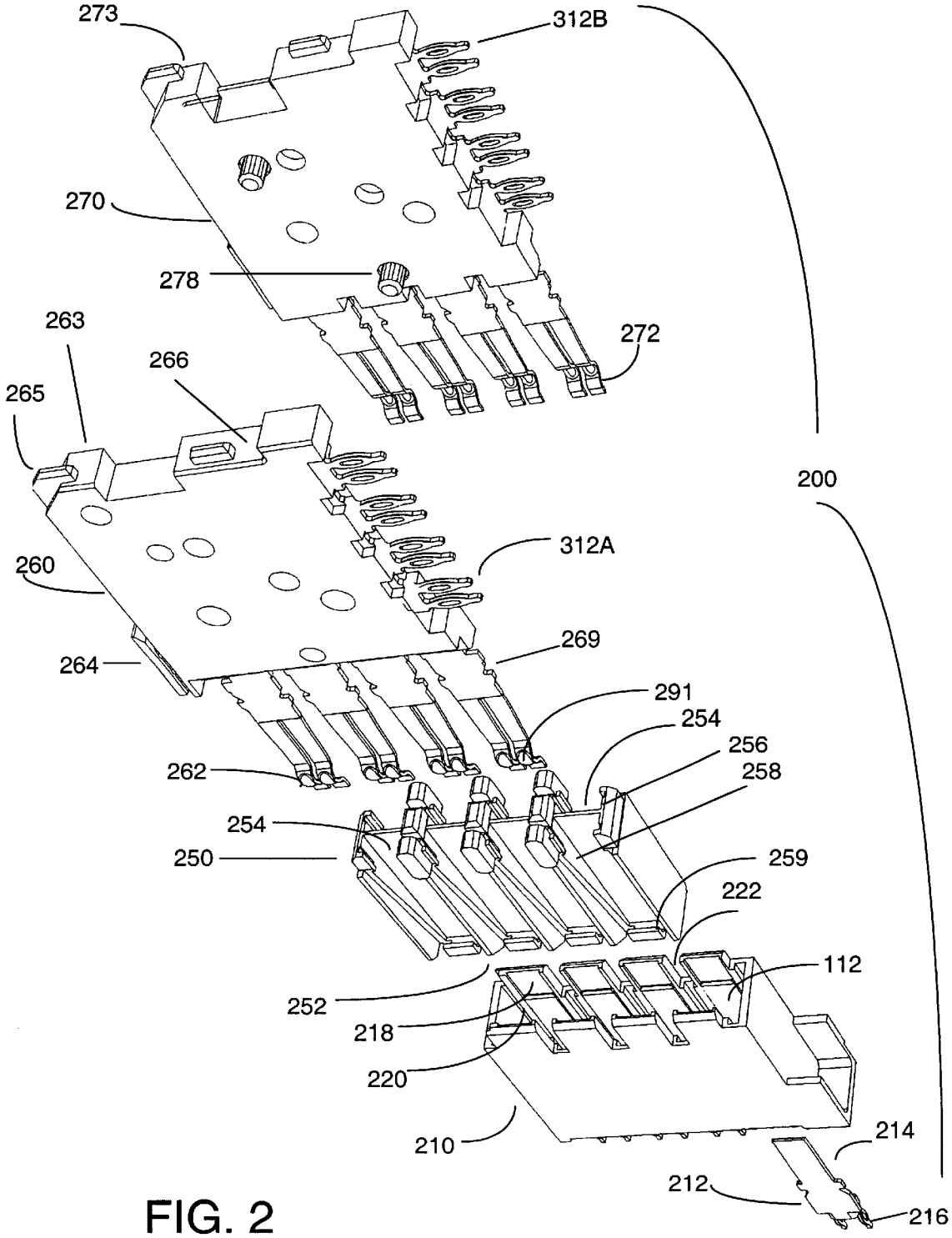
FIG. 2 shows an exploded view of a power connector made according to a preferred embodiment of the invention.

FIG. 2 shows a preferred embodiment of a power connector 200 according to the invention. Power connector 200 is intended to operate in conjunction with signal connectors, such as are shown in FIG. 1 and more fully described in provisional U.S. patent application Ser. No. 60/179,722 for a Connector with Egg Crate Shielding filed Feb. 3, 2000, which is hereby incorporated by reference. In particular, the daughter card portion of power connector 200 will attach to stiffener 142 along side the signal connectors and the backplane portions of power connector 200 will attach to backplane 104 along side backplane connectors 110.

FIG. 2 shows connector 200 in exploded view. A backplane portion of the power connector 200 contains a housing 210 and several power contacts 212. Housing 210 is preferably made of an insulative material. In the preferred embodiment, housing 210 is formed by molding, more preferably by injection molding.

The power contacts 212 are made of a conducting material. Copper alloys are often used for power contacts, but other high conductivity metals with suitable stiffness might be used. Each power contact 212 has a blade 214 and a plurality of contact tails 216. In the illustrated embodiment, two press fit contact tails are shown. In use, the press fit contact tails are pressed into plated through holes in a backplane to make contact to the power plane within the backplane.

In the embodiment of FIG. 2, there are eight power contacts 212 inside housing 210. The power contacts 212 are pressed through openings (not shown) in the floor of the housing 210. Each blade 214 runs up a groove 218 formed in the wall of housing 210. In the illustrated embodiment, the blades 214 line opposing walls of housing 210 leaving a cavity 220 between them. The specific number of blades in the backplane connector is not important to the invention. However, the backplane housing 210 preferably has the same width or smaller than the signal connector shroud 110 so that both signal connectors and power connectors may fit in a line.

Housing 210 is also formed with grooves 222. Grooves 222 receive projections 252 from the daughter card portion of the power connector during mating of the daughter card and backplane portions of the power connector. Grooves 222 are alignment features that ensure the power contacts are properly aligned.

The daughter card portion of the power connector is assembled from three components, a cap or alignment guide 25(), a water 260 and a wafer 270. Wafers 260 and 270 contain the power contacts Each of the wafers 260 and 270 are generally similar. However, the mating portions 262 and 272 of the power contacts bend in opposite directions to provide outwardly directed mating surfaces.

Figure 3:
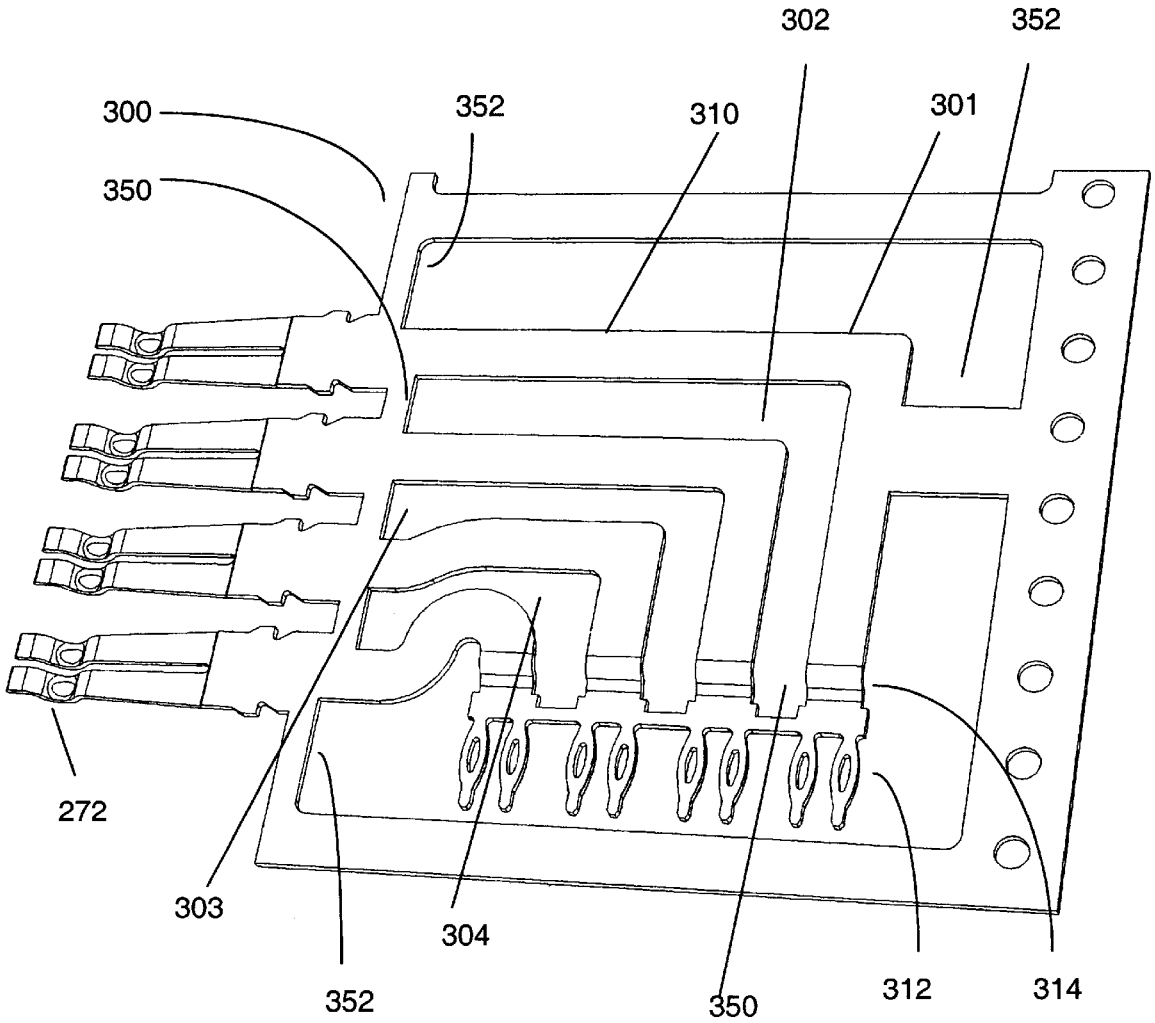
FIG. 3 is a sketch of contact blank used to make a wafer of the connector in FIG. 2.

Each of the wafers 260 and 270 is formed by molding a housing, 263 and 273 around contact blanks, such as contact blank 300 (FIG. 3). Preferably, the housing is formed of an insulative material, such as plastic. The housings contain attachment features, such as projections 264, 265 and 266 to attach the wafers to stiffener 142. Attachment features can be such things as tabs that slide into grooves or hubs that press through holes.

The housings 263 and 273 also contain alignment features to align the housings. In FIG. 2, projections 278 extend from the inner surface of wafer 270. Projections 278 fit in holes on the inner surface (not shown) of wafer 260 to align the wafers. Projections 278 also create an interference fit to hold wafers 260 and 270 together, which makes handling of the parts easier during manufacture. Other types of alignment and attachment features might be used, such as tabs or latches that create a snap fit.

Contact tails 312A and 312B extend from the bottom edge of the wafers 260 and 270, respectively. These contact tails attach the power connector to the daughter board. In the illustrated embodiment, contact tails 312A and 312B are on the same spacing along the columns of the connector as the contact tails 146 in the daughter card signal connector 120. Using the same spacing provides an advantage of allowing a uniform hole pattern across the printed circuit board, which can sometimes simplify manufacture, particularly the layout stage of the PCB design.

Contact mating portions 262 and 272 extend from the front edge of each wafer. In the illustrated embodiment, each contacts has a dual beam, providing two points of contact to a blade 214. As shown, each beam has a curved portion and a dimple 291 formed therein. Dimples 291 aid in making contact to blades 214 in the backplane portion of the power connector.

The contact portions are inserted into the alignment guide 250. The alignment guide is formed from an insulative material to prevent the contacts from shorting together. Preferably, it is molded from plastic. Alignment guide 250 contains a plurality of channels 254 formed therein. Each channel 254 receives one of the contacts 262, 272.

Alignment guide 250 has walls 256 and 258 that insulate the contacts from each other and thereby form the channels 254.

Each of the channels 254 has a lip 259 formed near the mating edge of alignment guide 250. When assembled, the front edge of the contact mating portions 262 and 272 will be pre-stressed outwards from the center of the daughter card portion of the power connector. Lip 259 will keep the leading edge of the contacts within the outline of the daughter card portion of the power connector so that they can be inserted into cavity 220 without stubbing. However, the contact mating portions will be pre-loaded to press outward against and will increase the force with which the dimples 291 press against blades 214, thereby improving the integrity of the contact.

To secure the alignment guide 250 to the wafers 260 and 270, each of the contacts contains barbs 269. When the alignment guide 250 is pressed onto the wafers, barbs 269 will engage features on walls 258 thereby securing the alignment guide to the wafers. Other methods of attachment could be used. For example, features could be molded into the alignment guide 250 and the housings 263 and 273 to create an interference fit or a snap fit.

FIG. 3 shows a wafer 270 at an early stage of manufacture. A power contact blank 300 is shown. This blank is stamped and formed from the material used to make the power contacts. In the preferred embodiment, a copper alloy is used. Preferably, numerous such blanks are stamped from a single large sheet of metal that can be rolled up for easy handling. The blank 300 is stamped with the desired number of power contacts, here power contacts 301, 302, 303, and 304. Each contact has a mating portion 272 and contact tails 312. In the illustrated embodiment, each of the contacts 301 . . . 304 has a contact tail 312 with two press fit contacts. Using multiple contacts increases the power carrying capacity while keeping the holes in the daughter card that receive the tails on a pitch that matches the pitch for the signal contact holes.

Each of the power contacts 301 . . . 304 has an intermediate portion that connects the tails 312 to the contact mating portions 272.

The individual contacts are held together by tie bars 350. The tie bars are severed to create electrically separate contacts. Preferably, the tie bars are separated after housing 273 is molded. The contact blank 300 is also held on carrier strips 352. These carrier strips are also severed after molding when no longer needed. In a preferred embodiment, the carrier strips contain holes that are used for positioning the contacts, which are not severed until no longer needed.

FIG. 3 shows that the contacts 301 . . . 304 have a jog 314 formed therein. Jog 314 takes the contact tails 312 away from the center of the daughter card connector. Jog 314 increases the spacing between the contact tails 312 in the wafers 260 and 270. Thus, the contact tails will enter holes in the printed circuit board that are further apart than if jog 314 were omitted. Providing greater separation between holes in printed circuit boards that carry relatively high voltage is desirable.

In addition, jogs 314 bring the contact tails 312 in line with holes that are spaced the same pitch as the holes along the rows used to mount the signal connectors. In the illustrated embodiment, the power connector is as wide as the wafers needed to carry three columns of signal contacts. Thus, jogs 314 make the spacing between the tails 312 in wafers 260 and 270 equal to the spacing between two signal wafers 136.

Figure 4:
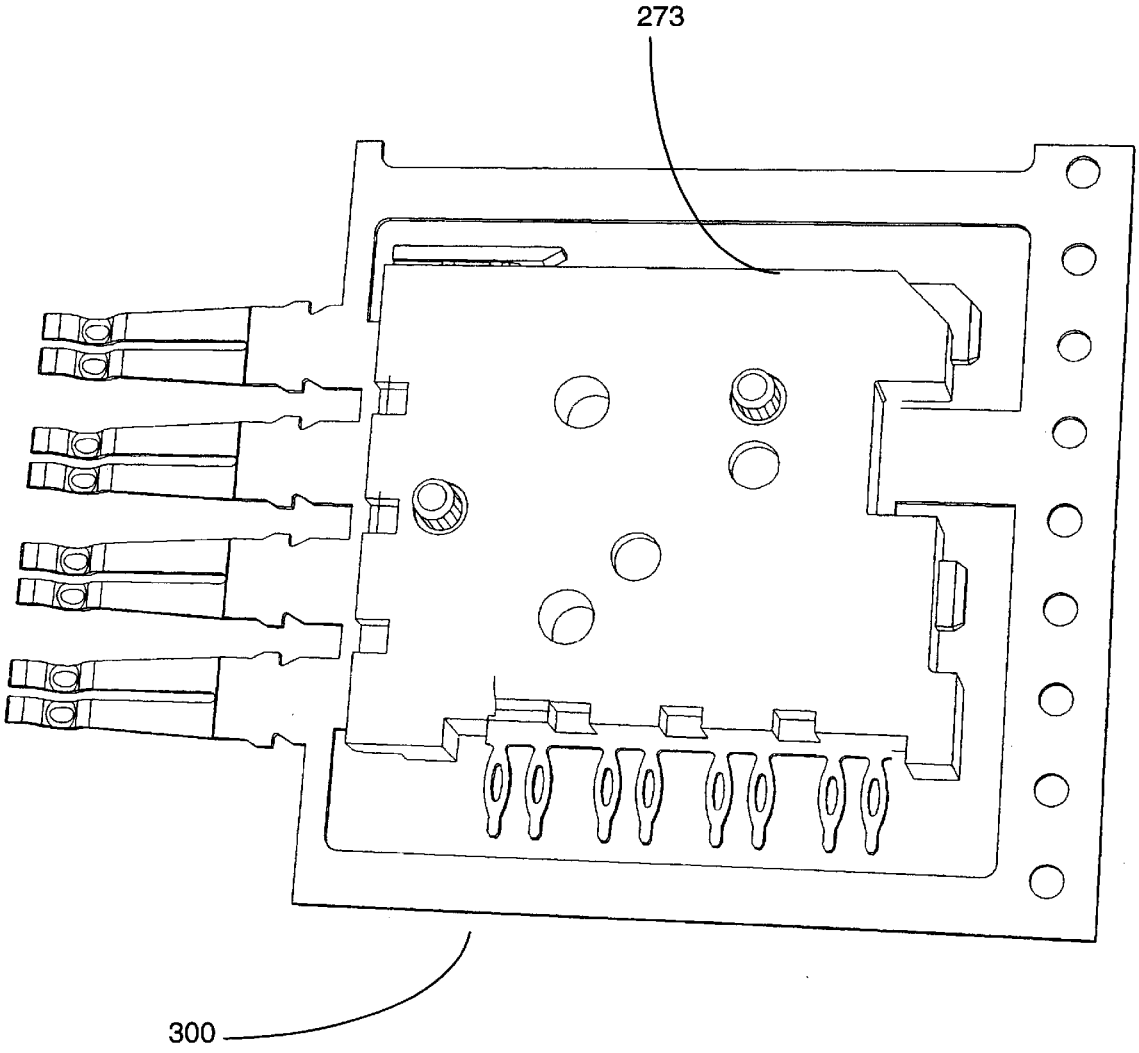
FIG. 4 is a sketch of a first wafer shown in FIG. 2.

Turning now to FIG. 4, the power contact blank is shown in a later stage of manufacture. The housing 273 is molded over the power contact blank 300. FIG. 4 shows the wafer 270 before carrier strips 352 and tie bars 350 are severed.

Figure 5:
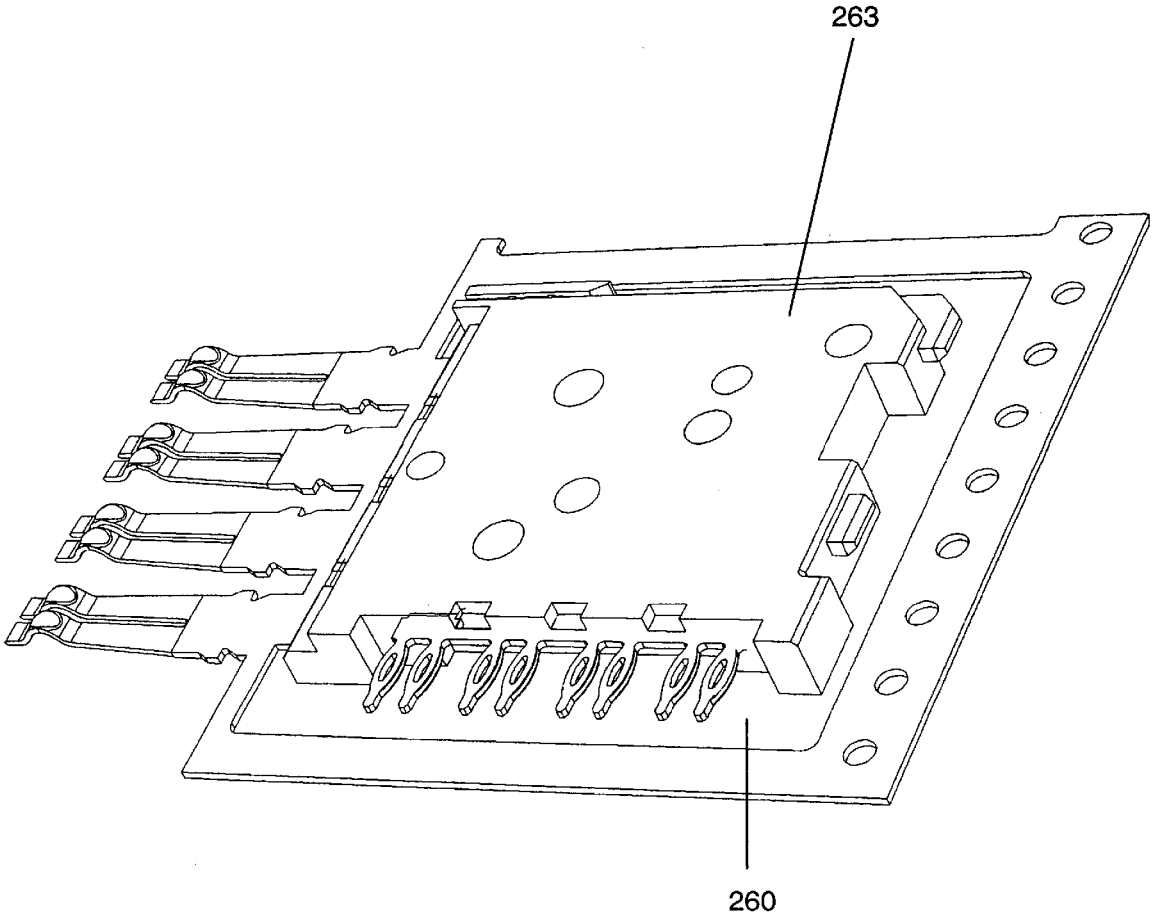
FIG. 5 is sketch of a second wafer shown in FIG. 2.

Wafer 260 is formed through a similar process. A complementary power contact blank is used. In particular, the mating portions 272 have an opposite curve and the jogs 314 are in the opposite direction. In both wafers, though, these portions bend away from the center of the daughter card connector. FIG. 5 shows wafer 260 after housing 263 has been molded over the power contact blank.

Figure 6:
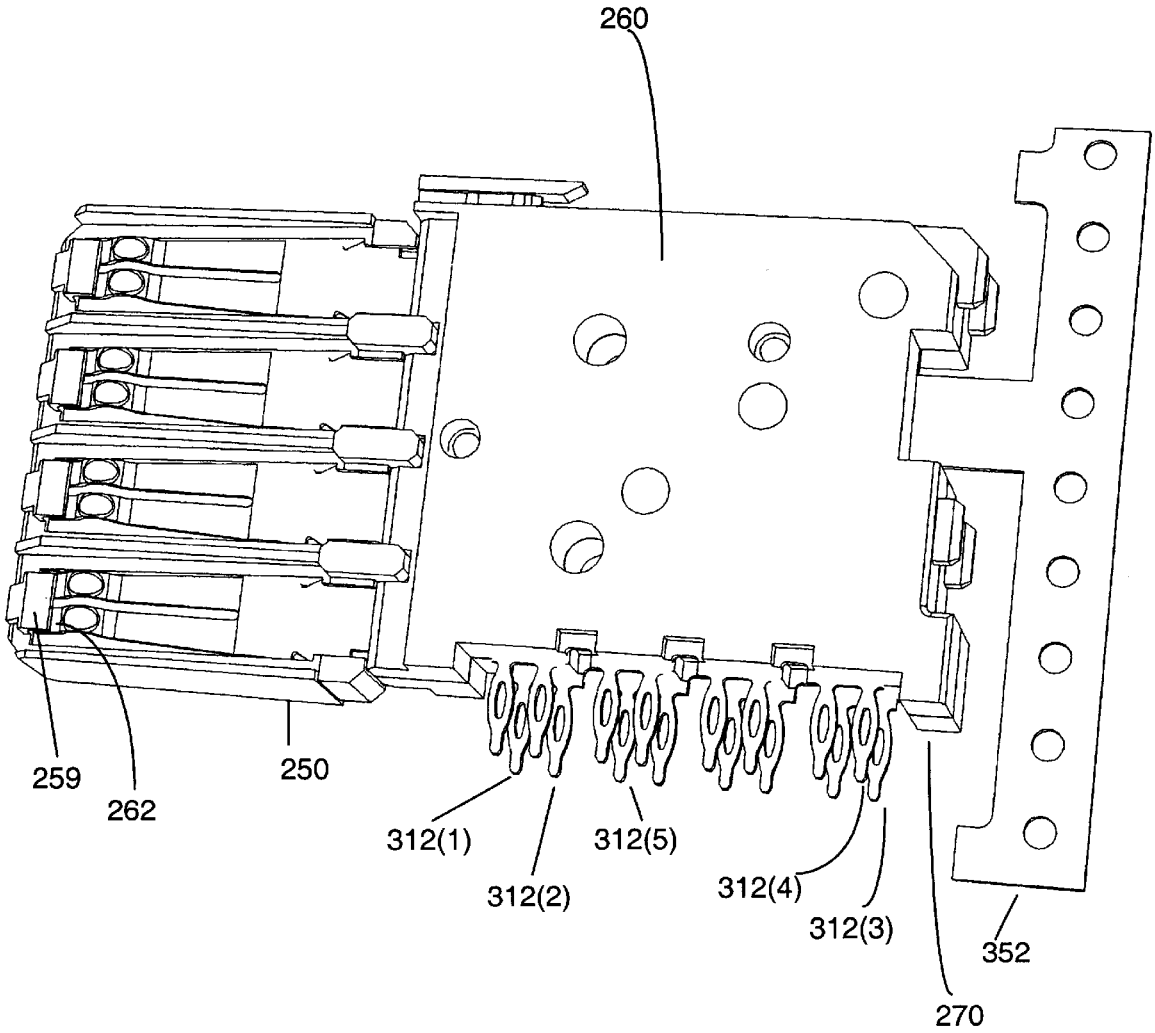
FIG. 6 is a sketch of a daughter card power connector according to the invention.

FIG. 6 shows the daughter card portion of the power connector during assembly. Wafers 260 and 270 have been attached. Also, alignment guide 250 has been inserted and secured to the wafers. Portions of carrier strip 352 remain for case of handling and can be removed at a subsequent step of manufacture.

FIG. 6 shows the mating portions 262 of the contacts under lip 259. To assemble the daughter card portion of the power connector, the mating portions 262 and 272 are pressed toward wall 256 (see FIG. 2) of alignment guide 250 so that they will slide under lip 259.

FIG. 6 also illustrates the spacing between contact tails 312 to facilitate use of the power connector in a backplane assembly including the signal waters shown in FIG. 1. As shown in FIG. 6, each of the power contacts has two contact tails, such as 312(1) and 312(2). These contact tails are oil the same pitch as the signal contact tails 146 of the signal connector of FIG. 1. The distance between the centers of contact tails 312(1) and 312(2) represents the spacing along a column of contacts.

In the signal connector optimized for handling differential signals, the signal contacts are disposed in pairs. And, the spacing between the tails of one pair and closest tail in an adjacent pair is greater than the spacing between contact tails in the same pair. In the preferred embodiment, the power connector of the invention has this same spacing. The distance between the centers of tails 312(2) and 312(5) matches the distance between the pairs of signal contact tails shown in FIG. 1.

The pitch of signal contacts within a row is the same for all power contact tails.

In FIG. 6, this spacing is given by the distance between the center lines of tails 312(3) and 312(4). Though the power connector subassembly containing wafers 260 and 270 might be wider than two signal wafers as shown in FIG. 1, the power connector subassembly preferably has a width that is an integer multiple of the width of a signal contact wafer. This width allows the signal and power contacts to be easily mounted to a support member, such as a metal stiffener that has preformed attachment features for the wafers. It also allows holes in the printed circuit board for attachment of the connectors to be drilled in a pattern that has uniform pitch—though where a power connector is used, a column of holes might be unused or not drilled. Or, the holes used for the power connector attachment are likely to be of larger diameter to carry more current. In the illustrated embodiment, the spacing between tails in a row is shown as the distance between tails 312(3) and 312(4) and that distance is twice the distance as the spacing between adjacent columns of signal contact tails.

In use, the power connector can be used to carry up to eight individual power signals. Alternatively, certain power contacts can be electrically connected together.

A power connector as described above has several advantages. First, it is easy to manufacture. Secondly, it is compatible with signal connection systems. It can fit on the same stiffener as the signal connectors. Further, it takes up only a little space. In the illustrated embodiment it takes up less than the space of three columns of signal contacts. Being able to fit eight separate power contacts in such a small space is very advantageous.

Another advantage is that the power connector according to the design is very flexible to achieve greater power capacity utilization. Such a connector has more power contacts than prior art power connectors, though in the preferred embodiment each has a lower current rating. For example, a prior art power connector has four large power contacts, each rated to carry 10 Amps, for a total of 40 Amps max. In one embodiment, the power connector of the invention uses stock 12 mils thick to make power contact blank 300. Each such contact carries 5 Amps, but for a total of 40 Amps max. Though each power connector has the same maximum power carrying capacity, the connector of the invention can be more efficient, particularly in a system when many voltage levels are required.

For example, consider a system in which four voltage levels are need: one at 1V and 2 Amps, one at 0V and 5A, one at 2.5V and 2 Amps and one at 5V and 15 Amps. In the prior art power connector, one 10 Amp contact can carry voltages at 1V, 0V and 2.5V because each has a current below the 10A level. However, two contacts are needed to carry all 15 Amps at 5V. Thus, a total of 5 contacts are needed. Because each connector has four contacts, two power connectors are needed. Of the total current carrying capacity of 80 Amps in the two power connectors only 24 Amps is carried in this example. In other words, only a 30% power capacity utilization is achieved.

With a connector as in the preferred embodiment, one contact can carry each of the 1V, 0V and 2.5V signals. Three contacts are needed to carry the 5V signal at 15 Amps. But, because there are 8 contacts in one connector, all signals can be carried in one power connector. The result is a 60% power capacity utilization and a much smaller area needed for power connectors because one, rather than two power connectors are needed.

And, in the preferred embodiment, the disclosed power connector is narrower than the prior art connector with 4 large blades.

Further, it should be noted that the intermediate portions 301 . . . 304 of the power contacts are generally in a plane and that this plane will be parallel to the plane of the signal contacts. As a result, the power conductors are generally running beside and parallel to the signal contacts. This configuration minimizes the inductance in the conductive loop that is formed by current flowing on and off the daughter card and is highly desirable for high speed interconnection systems.

Having described one embodiment, numerous alternative embodiments or variations might be made. For example, the connector is described as a right angle backplane connector. Connectors might also be used in a mezzanine or mother board application or in a cable configuration or in other ways, such as a midplane. These alternative embodiments can be created by changing the manner of attachment of the connector to a particular substrate. Likewise, press fit contacts are shown in the illustrated embodiment for attachment to a printed circuit boards. Even for connectors used in a backplane configuration, the specific attachment mechanism could be changed by changing the contact tails. Solder tails or other attachment mechanisms could be used.

Also, it is sometimes desirable to have a predefined mating sequence for power connectors. The blades 214 could be made of different lengths so that certain power contacts will mate first as the daughter card and backplane connectors are pressed together.

It should also be noted that the preferred embodiment is a power connector that is the width of three signal wafers. However, it would be possible to use thicker stock to make the power contacts and achieve higher current capacities. For example, 25 mil stock might be used to provide contacts of 10Amps each. With such a configuration, the power connector might be wider, such as the width of 4 signal wafers. Because the power connectors, if made an integer multiple of signal wafers easily fit on the same stiffener, the larger power connectors might be used instead of or in addition to smaller ones.

Also, it should be appreciated that the shape of the power contacts shown in FIG. 3 is illustrative. It would be desirable to make the intermediate portions 301 . . . 304 as wide as possible to reduce their impedance. Also, it might be desirable to make the power contacts as short as possible to reduce the inductance. Thus, the intermediate portions might be made without the sharp comers shown in intermediate portions 301 . . . 303 and might curve through a right angle with more of a smooth curve as shown in intermediate portions 304.

As another variation, it was indicated above that the tie bars 350 are severed before the power connector is used. However, when large current carrying capacity is required, power contacts will often be commoned together. Where power contacts are commoned, it might be desirable to leave the tie bars 350 joining the power contacts, because this would better balance the power flow. As yet another embodiment, the blades of the backplane connector could also be electrically connected inside the connector. For example, a U-shaped structure could be made in place of two blades.

Further, it is described that holes in the printed circuit board on the same pitch as the holes used to make connection top the signal contacts. The placement of the holes for the power connector can follow any pattern As a further variation, it would be possible to change the shape of the contacts. For example, the preferred embodiment shows the daughter card connector with mating contact portions 262 and 272 that are beams to provide spring force against the mating contact in the backplane connector. The mating contact is simply a flat blade. It would be possible to provide daughter card contacts that are blades and mating contacts in the backplane portion of the connector that include beams that generate spring force.

Therefore, the invention should be limited only by the spirit and scope of the appended claims.

What is claimed is:

1. A power connector having an intermateable first connector piece and second connector piece, the first connector piece comprising:

a) an insulative housing having a central cavity;

b) a plurality of blades at the periphery of the central cavity; and the second connector piece comprising:

a) a first wafer having power contacts running therethrough, the first wafer having a front edge and the power contacts of the first wafer having mating portions extending from the front edge of the first wafer;

b) a second wafer attached to the first wafer, the second wafer having power contacts running therethrough, the second wafer having a front edge and the power contacts of the second wafer having mating portions extending from the front edge of the second wafer;

c) a cap attached to the first wafer and the second wafer having an insulative wall disposed between the mating portions of the power contacts of the first wafer and the second wafer;

wherein the power contacts of the first wafer and the second wafer in the second connector piece are aligned with the blades in the first connector piece when the first and second connector pieces are mated.

2. The power connector of claim 1 wherein the housing of the first connector piece has opposing side walls with channels formed therein and the blades are disposed in the channels of the side walls.

3. The power connector of claim 1 wherein the power contacts of the first wafer and the second wafer of the second connector piece comprise dual beam contacts.

4. The power connector of claim 1 wherein the first wafer and the second wafer have attachment features thereon, thereby attaching the first wafer to the second wafer.

5. The power connector of claim 1 wherein the power contacts of the first wafer and the second wafer of the second connector piece have features formed thereon, said features engaging the cap, thereby attaching the cap to the first and second wafers.

6. The power connector of claim 1 wherein the power contacts of the second connector piece traverse a right angle.

7. The power connector of claim 1 wherein the cap additionally has a plurality of insulative walls between adjacent power contacts on each of the first and second wafer.

8. The power connector of claim 1 wherein the cap has a front edge with a plurality of lips along the front edge such that ends of the mating portions of the power contacts of the first and second wafers are under respective ones of the plurality of lips.

9. The power connector of claim 8 wherein the insulative housing of the first connector piece has opposing side walls with channels formed therein and the blades are disposed in the channels of the side walls.

10. The power connector of claim 9 wherein power contacts of the second connector piece have features formed thereon, said features engaging the cap, thereby attaching the cap to the first and second wafers.

11. A power connector having an intermateable first connector piece and second connector piece, the first connector piece comprising:

a) an insulative housing having a cavity;

b) a plurality of blades at the periphery of the cavity; and the second connector piece comprising:

a) a power subassembly made from a plurality of wafers, the wafers each having a major surface with the major surfaces of the wafers aligned in parallel with each other, each of the wafers further comprising a plurality of electrically separable power contacts, the power contacts of the wafers having mating portions positioned to enter the cavity of the insulative housing of the first connector piece when the first and second connector pieces are mated and to engage the blades of the first connector piece;

b) a plurality of signal wafers, each signal wafer having a major surface with the major surfaces of the signal wafers being aligned in parallel with the major surfaces of the power wafers.

12. The power connector of claim 11 wherein the second connector piece further comprises a support member having points of attachment spaced on a predetermined pitch, the signal wafers and the powers wafers each being attached to the points of attachment.

13. The power connector of claim 11 wherein the plurality of signal wafers repeat on a predetermined pitch and the power subassembly has a width that is an integer multiple of the predetermined pitch.

14. The power connector of claim 13 wherein the integer multiple is 3.

15. The power connector of claim 11 wherein the signal wafers include differential signal wafers each having a plurality of pairs of contact tails with spacing between the contact tails being a first distance and spacing between the contacts in different pairs being a second, larger distance, and wherein the power subassembly includes a plurality of contact tails aligned with the contact tails of the differential signal wafers.

16. The power connector of claim 15 additionally comprising a support member having a repeating pattern of holes punched therein at regular intervals and the signal wafers and power wafers are attached to the support member at the holes.

17. A power connector having an intermateable first connector piece and second connector piece, the first connector piece comprising:

a) a first insulative housing having opposing inward facing walls;

b) a plurality of power contacts disposed in the insulative housing alone the inward facing walls; a second connector piece comprising:

a) a second insulative housing having a mating portion adapted to fit between the inward facing walls of the first insulative housing of the first connector piece, the second insulative housing having a first and a second outwdardly directed sides parallel with the inward facing walls of the first insulative housing of the first connector piece;

b) a first plurality of electrically separable power contact elements within the second insulative housing bent in a right angle in a first plane and having exposed contact portions exposed on the first outwardly directed side;

c) a second plurality of electrically separable power contact elements within the second insulative housing bent in a right angle in a second plane and having exposed contact portions exposed on the second outwardly directed side.

18. The power connector of claim 17 wherein the second insulative housing comprises a plurality of separable pieces wherein the first plurality of power contacts is molded within a first separable piece and the second plurality of power contacts is molded within a second separable piece.

19. The power connector of claim 18 wherein the second insulative housing additionally comprises a third piece having an insulative wall disposed between the exposed contact portions of the first plurality of power contacts and the exposed contact portions of the second plurality of power contacts.

20. The power connector of claim 19 wherein power contacts contain barbs thereon and the third piece of the insulative housing is secured to the barbs.

* * * * *

UNITED STATES PATENT AND TRADEMARK OFFICE

CERTIFICATE OF CORRECTION

PATENT NO. : 6,592,381 B2
APPLICATION NO. : 09/769867
DATED : July 15, 2003
INVENTOR(S) : Thomas S. Cohen et al.

It is certified that error appears in the above-identified patent and that said Letters Patent is hereby corrected as shown below:

Column 4, line 61, the first word in the line "case" should be -- ease --.

Column 5, line 5, the last word in the line "oil" should be -- on --.

Column 7, line 17, the first complete word in the line "top" should be -- to --.

Column 9, claim 17, line 4, the second word in the line "alone" should be -- along --.

Column 9, claim 17, line 10, the second word in the line "outwdardly" should be -- outwardly --.

Signed and Sealed this
Twenty-seventh Day of September, 2011

David J. Kappos

David J. Kappos
*Director of the United States Patent and Trademark Office*